US010116092B2

(12) United States Patent
Lord et al.

(10) Patent No.: US 10,116,092 B2
(45) Date of Patent: Oct. 30, 2018

(54) ELECTRICAL CONNECTOR INCLUDING GUIDE MEMBER

(71) Applicant: FCI USA LLC, Etters, PA (US)

(72) Inventors: Hung-Wei Lord, Harrisburg, PA (US); Michael Scholeno, York, PA (US)

(73) Assignee: FCI USA LLC, Etters, PA (US)

( * ) Notice: Subject to any disclaimer, the term of this patent is extended or adjusted under 35 U.S.C. 154(b) by 4 days.

(21) Appl. No.: 15/038,864

(22) PCT Filed: Nov. 24, 2014

(86) PCT No.: PCT/US2014/067044

§ 371 (c)(1),
(2) Date: May 24, 2016

(87) PCT Pub. No.: WO2015/080997

PCT Pub. Date: Jun. 4, 2015

(65) Prior Publication Data

US 2016/0380383 A1 Dec. 29, 2016

Related U.S. Application Data

(60) Provisional application No. 61/909,710, filed on Nov. 27, 2013.

(51) Int. Cl.
*H01R 13/631* (2006.01)
*H01R 12/71* (2011.01)
(Continued)

(52) U.S. Cl.
CPC ..... *H01R 13/631* (2013.01); *H01R 12/716* (2013.01); *H01R 12/91* (2013.01); *H01R 13/6471* (2013.01)

(58) Field of Classification Search
CPC ..... H01R 4/22; H01R 13/64; H01R 13/648; H01R 13/40; H01R 13/631;
(Continued)

(56) References Cited

U.S. PATENT DOCUMENTS 4,084,875 A * 4/1978 Yamamoto ..... H01R 13/629 340/687
4,184,729 A * 1/1980 Parks ..... H01R 12/62 29/830

(Continued)

FOREIGN PATENT DOCUMENTS

JP 3 114 486 B2 12/2000
JP 2013-152947 A 8/2013
WO WO 99-38320 A1 7/1999

OTHER PUBLICATIONS

International Search Report and Written Opinion for International Application No. PCT/US2014/067044 dated Feb. 27, 2015.

(Continued)

*Primary Examiner* — Michael A Lyons
*Assistant Examiner* — Milagros Jeancharles
(74) *Attorney, Agent, or Firm* — Wolf, Greenfield & Sacks, P.C.

(57) ABSTRACT

An electrical connector includes an electrical contact assembly that includes an electrical contact and an electrically insulative guide member.

21 Claims, 7 Drawing Sheets

(51) Int. Cl.
*H01R 12/91* (2011.01)
*H01R 13/6471* (2011.01)

(58) Field of Classification Search
CPC .. H01R 13/6471; H01R 13/658; H01R 12/91; H01R 12/716; Y10T 29/49224; H05K 9/0058
USPC ..... 439/374, 886, 741, 579, 133–145, 676, 439/695, 707, 709, 718, 732, 541, 79, 439/607.01
See application file for complete search history.

(56) References Cited

U.S. PATENT DOCUMENTS 4,260,212 A * 4/1981 Ritchie ..... H01R 4/2425 29/885
4,776,803 A * 10/1988 Pretchel ..... H01R 12/675 249/97
4,832,613 A * 5/1989 Tsukakoshi ..... H01R 13/631 439/141
4,850,888 A * 7/1989 Denlinger ..... H01R 13/7032 439/188
5,085,601 A * 2/1992 Buchter ..... H01R 12/82 439/660
5,306,182 A * 4/1994 Fukushima ..... H01R 23/68 439/857
5,342,211 A * 8/1994 Broeksteeg ..... H01R 13/6587 439/108
5,431,576 A * 7/1995 Matthews ..... H01R 13/113 439/247
5,651,685 A * 7/1997 Brinkman ..... H01R 13/641 439/490
5,741,148 A * 4/1998 Biernath ..... H01R 12/79 439/284
5,980,318 A 11/1999 Morello et al.
6,053,751 A * 4/2000 Humphrey ..... H01R 12/716 439/108
6,290,540 B1 * 9/2001 Nishio ..... H01R 13/658 439/607.36
6,350,157 B1 * 2/2002 Mizusawa ..... H01R 13/6456 439/676
6,439,919 B1 * 8/2002 Yasufuku ..... H05K 1/117 439/377
6,659,809 B2 * 12/2003 Wang ..... H01R 13/6456 439/490
6,835,091 B2 * 12/2004 Oleynick ..... H01R 13/658 439/541.5
6,846,202 B1 * 1/2005 Schmidt ..... H01R 13/26 439/247
6,923,661 B1 * 8/2005 Bogiel ..... H01R 12/721 439/78
7,445,502 B2 * 11/2008 Zhang ..... H01R 13/658 439/607.01
7,488,222 B2 * 2/2009 Clark ..... H01R 13/11 439/65
7,537,471 B2 * 5/2009 Teicher ..... H01R 13/64 439/172
8,388,389 B2 * 3/2013 Costello ..... H01R 13/18 439/637
8,545,240 B2 * 10/2013 Casher ..... H01R 29/00 439/108
9,277,649 B2 * 3/2016 Ellison ..... H01R 12/523
9,350,125 B2 * 5/2016 Jones ..... H01R 24/60
9,419,356 B2 * 8/2016 Copper ..... H01R 12/7076
2003/0022560 A1 * 1/2003 Zemanik ..... H01R 13/4223 439/676
2006/0024997 A1 * 2/2006 Teicher ..... H01R 27/00 439/217
2006/0160429 A1 7/2006 Dawiedczyk et al.
2007/0010115 A1 * 1/2007 Teicher ..... H01R 27/00 439/173
2008/0119076 A1 * 5/2008 Teicher ..... H01R 13/64 439/171
2013/0092429 A1 * 4/2013 Ellison ..... H01R 12/523 174/264

OTHER PUBLICATIONS

International Preliminary Report on Patentability for International Application No. PCT/US2014/067044 dated Jun. 9, 2016.

* cited by examiner

ELECTRICAL CONNECTOR INCLUDING GUIDE MEMBER

CROSS-REFERENCE TO RELATED APPLICATIONS

This application is the National Stage of International Application No. PCT/US2014/067044 filed Nov. 24, 2014, which claims the benefit of U.S. application No. 61/909,710, filed Nov. 27, 2013, the disclosures of which are incorporated herein by reference in their entireties.

BACKGROUND

Electrical connectors provide signal connections between electronic devices using electrical contacts. Often, the electrical contacts define electrical stubs that exhibit nonoptimal electrical properties. Thus, the electrical contacts can lessen the performance of the electrical connector, which can be especially detrimental in light of the continued miniaturization of electronic devices, and the ever-increasing desire for high-speed electronic communications.

SUMMARY

In one embodiment, an electrical connector is configured to mate with a complementary electrical component. The electrical connector can include an electrically insulative connector housing and at least one electrical contact including a mating end. The connector housing can include at least one movable electrically insulative guide member that is disposed adjacent the mating end of the at least one electrical contact. The at least one movable electrically insulative guide member can be configured to prevent the at least one electrical contact from stubbing on a corresponding mating portion of the complementary electrical component.

In accordance with one example embodiment, the connector housing defines a receptacle configured to receive the complementary electrical component along a mating direction. The at least one electrical contact can include first and second contact beams that each define the mating end that is at least partially disposed in the receptacle. The first and second contact beams can be spaced from each other along a transverse direction that is substantially perpendicular to the mating direction. The connector housing can include the at least one electrically insulative guide member that can define a lead in that is disposed adjacent the mating end. The at least one electrically insulative guide member can define a guide surface along a plane that is angularly offset with respect to each of the mating direction and the transverse direction, such that the guide surface is configured to guide the complementary electrical component from the one of the first and second contact beams toward the other of the first and second contact beams as the complementary electrical component is received by the receptacle along the mating direction.

BRIEF DESCRIPTION OF THE DRAWINGS

The foregoing summary, as well as the following detailed description of example embodiments, are better understood when read in conjunction with the appended diagrammatic drawings. For the purpose of illustrating the invention, the drawings show illustrative embodiments. The invention is not limited, however, to the specific embodiments disclosed in the drawings.

DETAILED DESCRIPTION OF ILLUSTRATIVE EMBODIMENTS

Electrical performance of existing electrical connectors having differential signal pairs, such as serial advanced technology attachment (SATA), serial attached small computer system interface (SCSI or SAS), including mini-SAS HD connectors, CXP connectors, back panel, and mezzanine connectors can be improved by minimizing the stub of electrical contacts, such as by using a guide member as described herein. Existing electrical connectors that can be improved are described in U.S. patent application Ser. No. 13/644,092, filed on Oct. 3, 2012, the disclosure of which is hereby incorporated by reference as if set forth in its entirety herein.

Figure 1A:
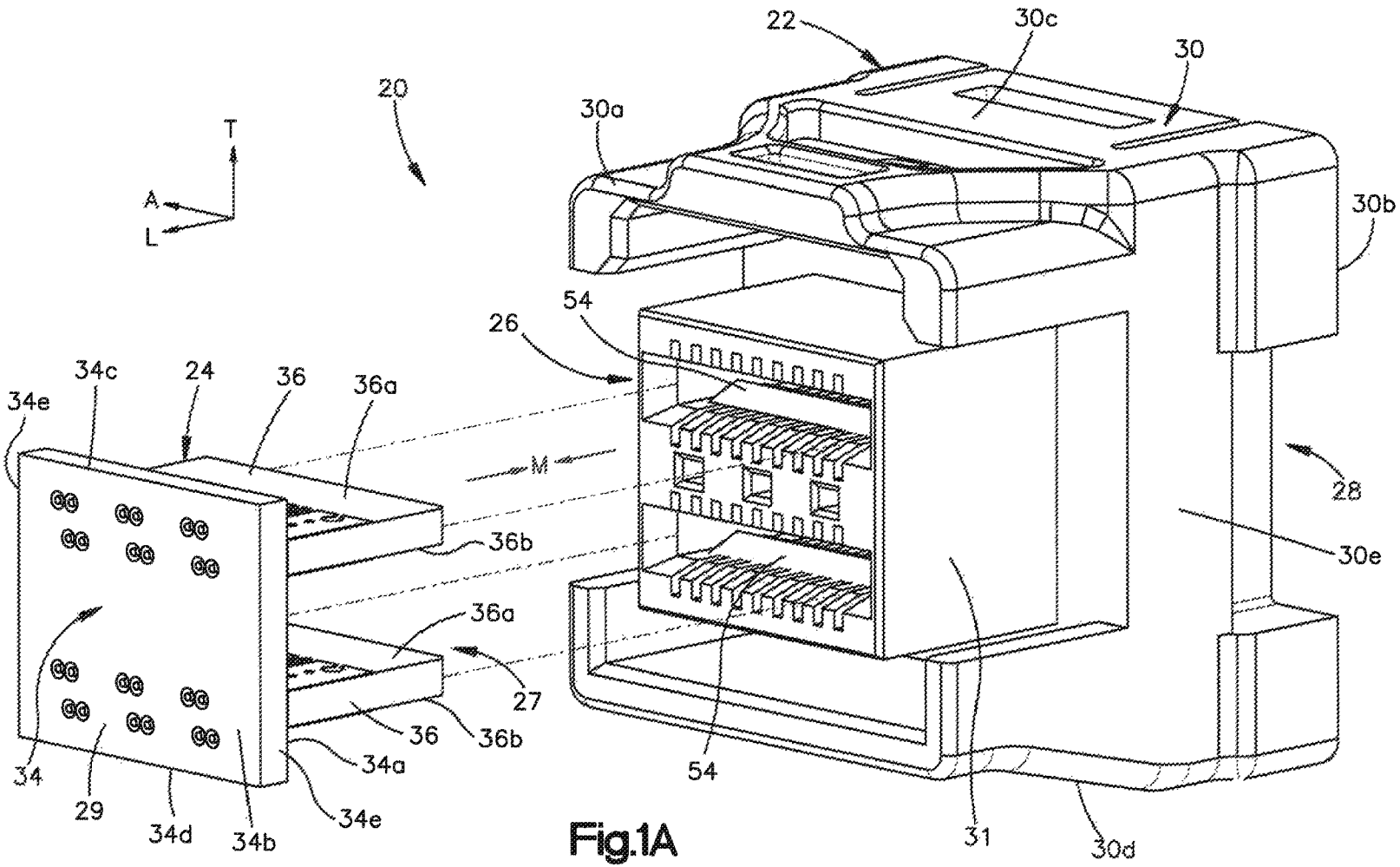
FIG. 1A is a perspective view of an electrical connector assembly including first and second electrical connectors aligned to be mated with each other along a mating direction.
Figure 1B:
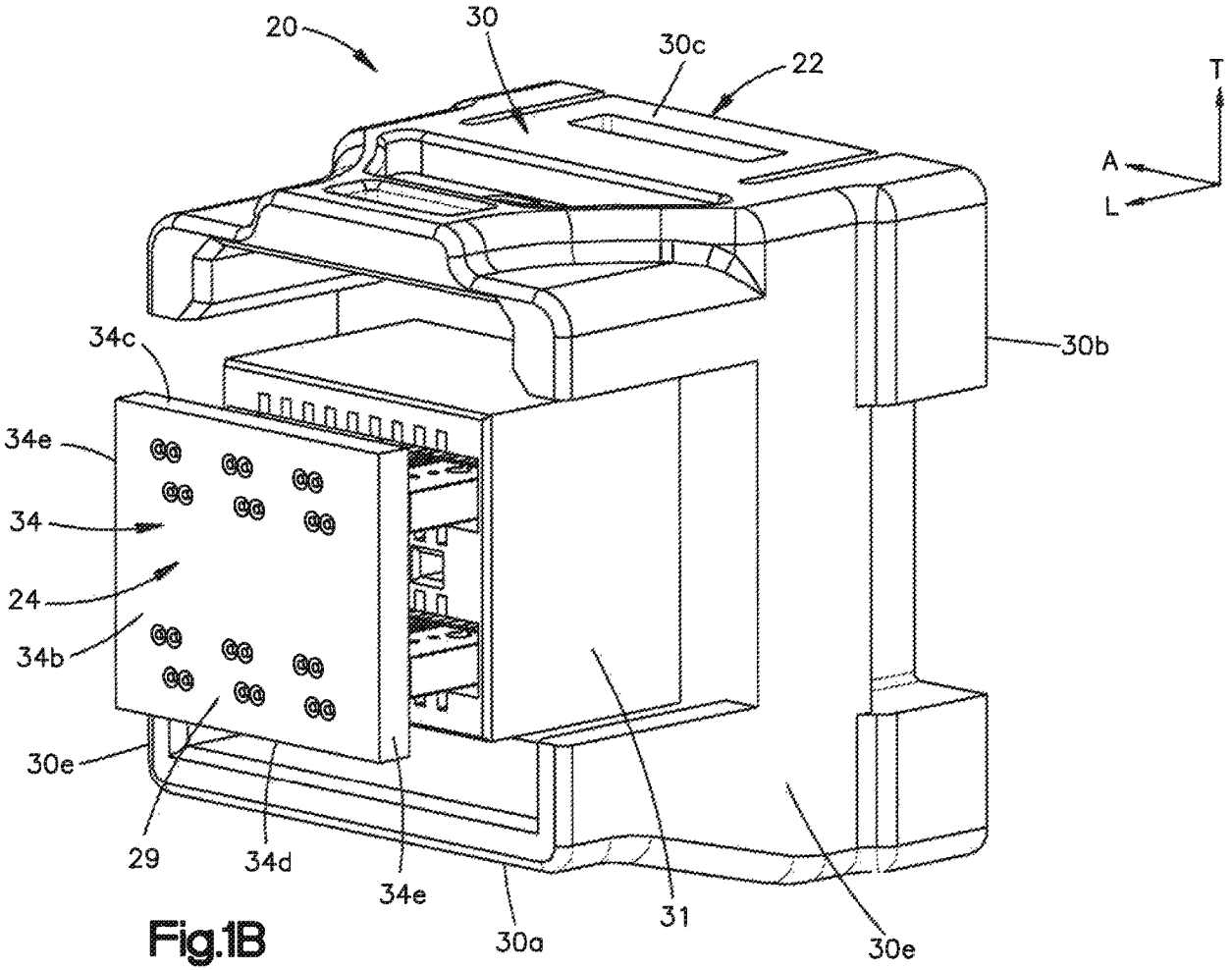
FIG. 1B is a perspective view of the electrical connector assembly of FIG. 1 shown with the first and second electrical connectors mated with each other.

Referring to FIGS. 1A and 1B, an electrical connector assembly 20 includes a first electrical connector 22 and a complementary or second electrical connector 24, such that the first and second electrical connectors 22 and 24 are configured to be mated with each other along a mating direction M. The complementary or second electrical connector 24 can also be referred to as a complementary electrical component 24. As shown, the first electrical connector 22 can be a SAS connector, including a mini-SAS HD connector, a SATA connector, a CXP connector, or any other suitable alternative electrical connector as desired, including an optical connector. The first electrical connector 22 can include a mating interface 26 configured to mate with the second electrical connector 24 so as to establish an electrical connection between the first and second electrical connectors 22 and 24, respectively. The first electrical connector 22 can further include a mounting interface 28 configured to be mounted onto a corresponding electrical component, such as a substrate which can be a printed circuit board, so as to establish an electrical connection between the first electrical connector 22 and the corresponding electrical component. Thus, when the first electrical connector 22 is fully mated with the second electrical connector 24 and the corresponding electrical component, the first electrical connector 22 places the corresponding electrical component and the second electrical connector 24 in electrical communication with each other.

In accordance with the illustrated embodiment, the first electrical connector 22 includes a dielectric or electrically insulative connector housing 30 and a plurality of electrical contacts 32 that are supported by the connector housing 30. The connector housing 30 defines a front end 30*a* and an opposed rear end 30*b* that is spaced from the front end 30*a* along a longitudinal direction L, a top end 30*c* and an opposed bottom end 30*d* that is spaced from the top end 30*c* along a transverse direction T that is substantially perpendicular to the longitudinal direction L, and opposed sides 30*e* that are spaced from each other along a lateral direction A that is perpendicular to both the transverse direction T and the longitudinal direction L. Unless otherwise indicated herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described.

As will be appreciated from the description below, the front end 30*a* can define the mating interface 26 that is configured to be mated to a mating interface 27 of the second electrical connector 24 along the longitudinal direction L, which can define the mating direction M. The bottom end 30*d* can define the mounting interface 28 that is configured to be mounted onto the corresponding electrical component along the transverse direction T. Because the mating interface 26 in FIG. 1 is oriented parallel with respect to the mounting interface 28, the electrical connector 22 can be referred to as a vertical electrical connector. Alternatively, referring to FIG. 2C, the bottom end 30*d* can define the mounting interface 28 that is configured to be mounted onto the corresponding electrical component along the longitudinal direction L. Thus, the electrical connector 22 can be configured as a right-angle electrical connector, whereby the mating interface 26 is oriented perpendicular to the mounting interface 28.

It should be appreciated that while the longitudinal and lateral directions L and A, respectively, are illustrated as extending along a horizontal plane, and that the transverse direction T is illustrated as extending along a vertical plane, the planes that encompass the various directions may differ during use, depending, for instance, on the orientation of the various components. Accordingly, the directional terms "vertical" and "horizontal" are used to describe the connector assembly 20 and its components as illustrated merely for the purposes of clarity and convenience, it being appreciated that these orientations may change during use.

Referring to FIGS. 2A to 2D, each of the electrical contacts 32 includes a mating end 32*a* that is disposed proximate to the mating interface 26 and configured to mate with a corresponding mating portion of the second electrical connector 24 when the first electrical connector 22 is mated to the second electrical connector 24. Each of the electrical contacts 32 further defines a mounting end 32*b* that is configured to be mounted to the corresponding electrical component. In accordance with the illustrated embodiment in FIG. 2, the mating ends 32*a* are orientated along the longitudinal direction L and are opposite the mounting ends 32*b*, and the mounting ends 32*b* are orientated along the longitudinal direction L. Because the mating ends 32*a* are orientated parallel to the mounting ends 32*b*, the electrical contacts 32 can be referred to as vertical electrical contacts. Alternatively, the electrical contacts 32 can be configured as right-angle electrical contacts, whereby the mating ends 32*a* are oriented perpendicular to the mounting ends 32*b*.

Figure 3A:
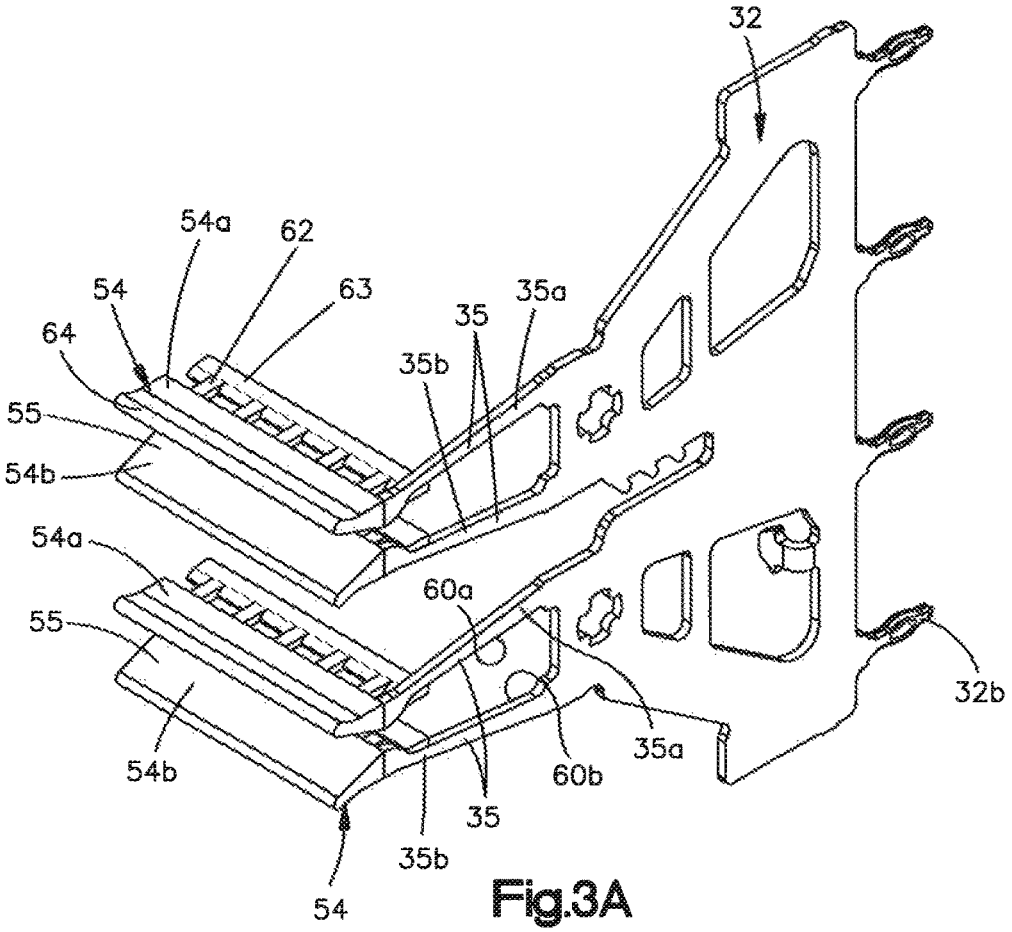
FIG. 3A is a perspective view of a portion of the electrical contact assembly of the first electrical connector shown in FIG. 1.

The electrical contacts 32 can be arranged as desired. Referring also to FIG. 3A, for instance, in accordance with the illustrated embodiment, the electrical contacts 32 each define at least one contact beam 35, such as at least one pair of contact beams 35, wherein each contact beam 35 in the pair of contact beams 35 is spaced from each other along the transverse direction T at the mating interface 26. For instance, in accordance with the illustrated embodiment, the electrical contacts 32 can each define two pairs of contact beams 35 spaced from each other along the transverse direction T at the mating interface 26, though it will be understood that the electrical contacts 32 can define any number of contact beams as desired. The pairs of contact beams 35 can be arranged in rows, wherein the pairs of contact beams 35 of each row are spaced from each other along the lateral direction A. The connector housing 30, and thus the electrical connector 22, can define at least one receptacle 33 at the mating interface 26.

Figure 4:
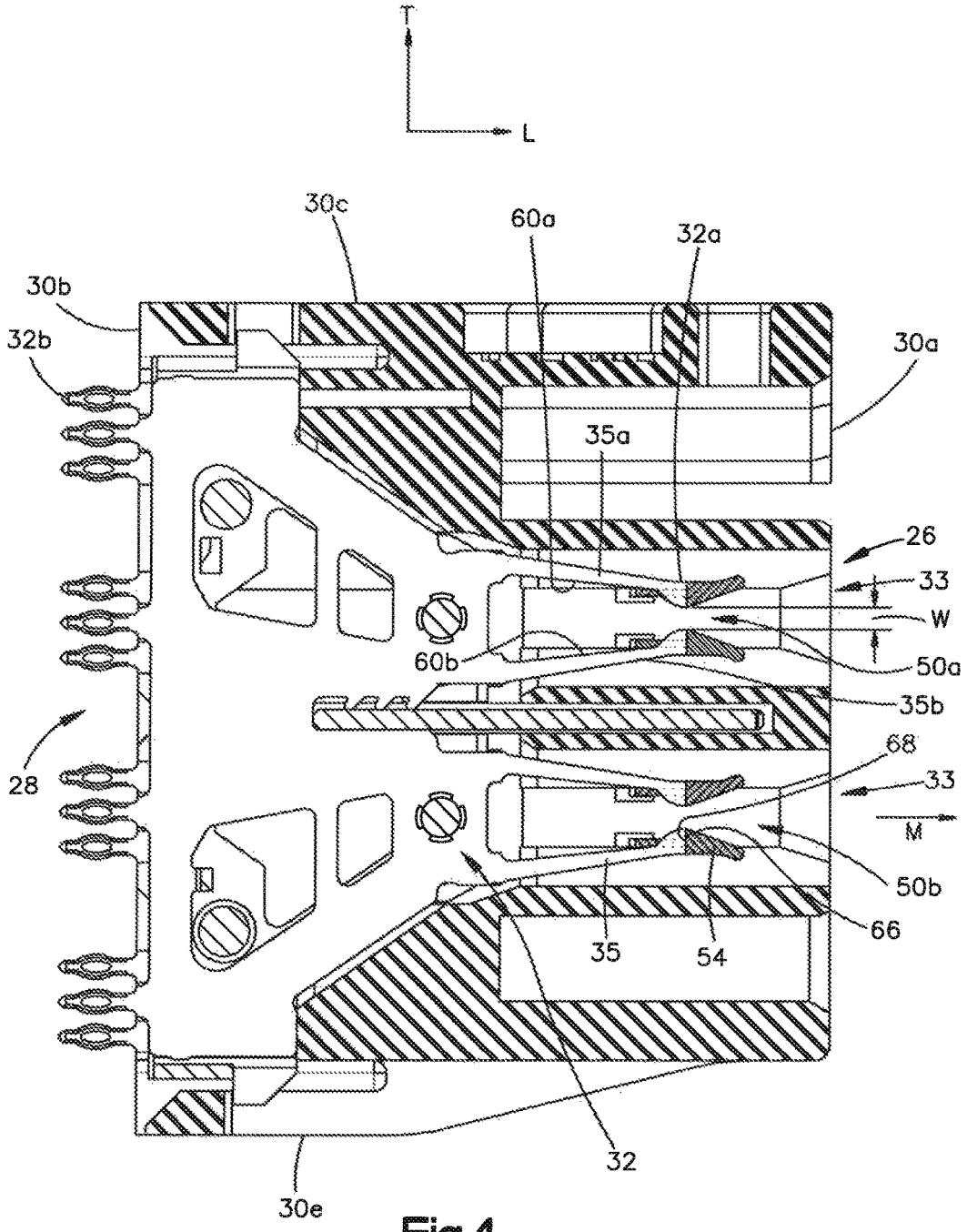
FIG. 4 is a sectional side elevation view of the first electrical connector including the electrical contact assembly constructed in accordance with one embodiment.

Referring in particular to FIG. 4, in accordance with the illustrated embodiment, the mating interface 26 defines two rows of pairs of contact beams 35, such that each row defines corresponding gaps 50*a* and 50*b* that are spaced from each other along the transverse direction T and configured to receive a complementary electrical component that includes at least one printed circuit 36 or alternatively constructed mating portion of the second electrical connector 24 so as to mate the first electrical connector 22 to the second electrical connector 24. For instance, the gap 50*a* can be sized so as to receive the printed circuit board 36 along the mating direction M and the gap 50*b* can be sized to receive the printed circuit board 36 along the mating direction M. Thus, the first electrical connector 22 can be referred to as a receptacle connector that includes electrical contacts 32 that are configured to receive the mating portion of the second electrical connector 24. While the electrical connector 22 is illustrated as defining first and second receptacles 33, it should be appreciated that the electrical connector 22 can define any number of receptacles 33 as desired, for instance at least one receptacle. Each receptacle 33 can be elongate along the lateral direction A and can be configured to receive the mating portion of the second electrical connector 24 along the mating direction M. Each gap 50 can be defined by a pair of contact beams 35, for instance first and second contact beams 35*a* and 35*b*, that are disposed on opposed transverse sides of the receptacle 33, such that the electrical contacts 32 are configured to establish an electrical connection with the printed circuit board 36 of the second electrical connector 24 that is received by the receptacle 33. The gap 50 can define a width W measured along the transverse direction T.

At least one, up to all, of the electrical contacts 32 can define signal contacts 37 and at least one such as a plurality of the electrical contacts 32 can define ground contacts 39 that can be disposed between adjacent signal contacts 37. For instance, adjacent signal contacts 37 of each row that are spaced along the lateral direction A can define differential signal pairs, and the ground contacts 39 can be disposed between adjacent differential signal pairs along the row, or can be otherwise disposed as desired. Thus, the electrical contacts 32 can define a repeating S-S-G pattern, G-S-S pattern, S-G-S pattern along the lateral direction A in the respective row, or can define any other pattern as desired.

Figure 2B:
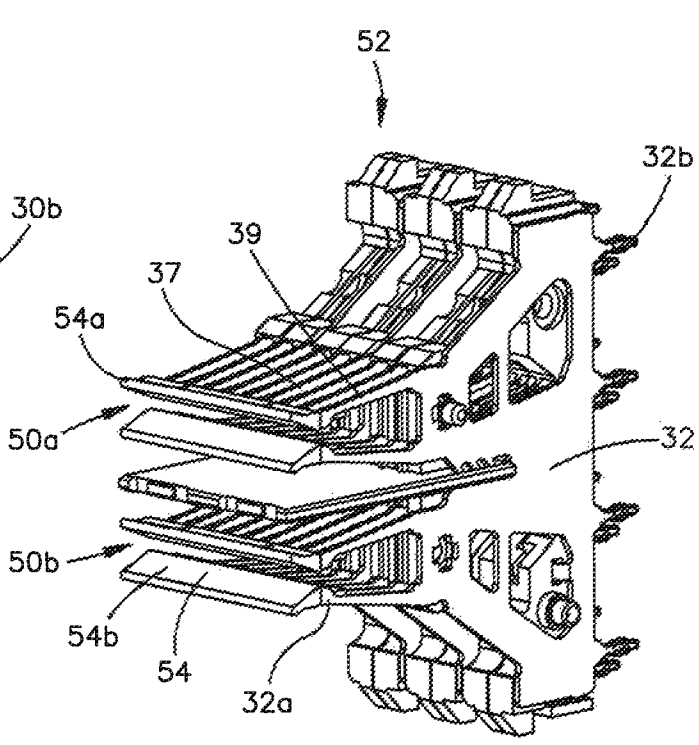
FIG. 2B is a perspective view similar to FIG. 2A, but only an electrical contact assembly of the first electrical connector shown in FIG. 1 is shown, wherein the electrical contact assembly includes a plurality of electrical contacts and guide members.
Figure 2A:
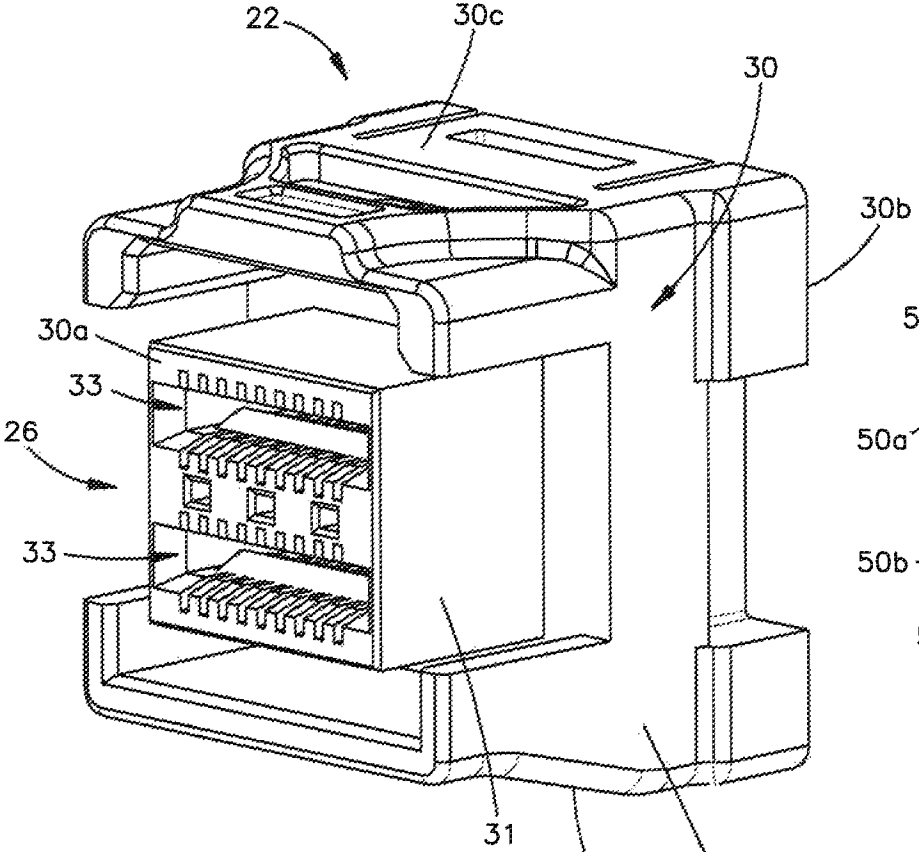
FIG. 2A is a perspective view of the first electrical connector shown in FIG. 1.
Figure 2D:
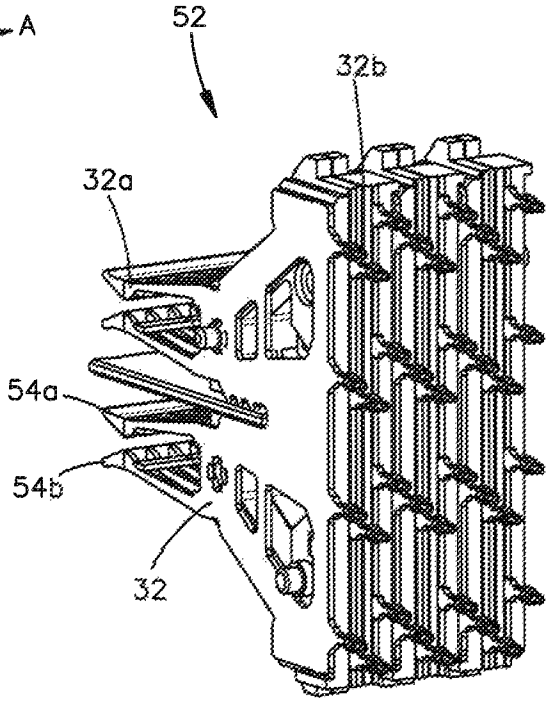
FIG. 2D is a perspective view similar to FIG. 2C, but only showing the electrical contact assembly of the first electrical connector.
Figure 2C:
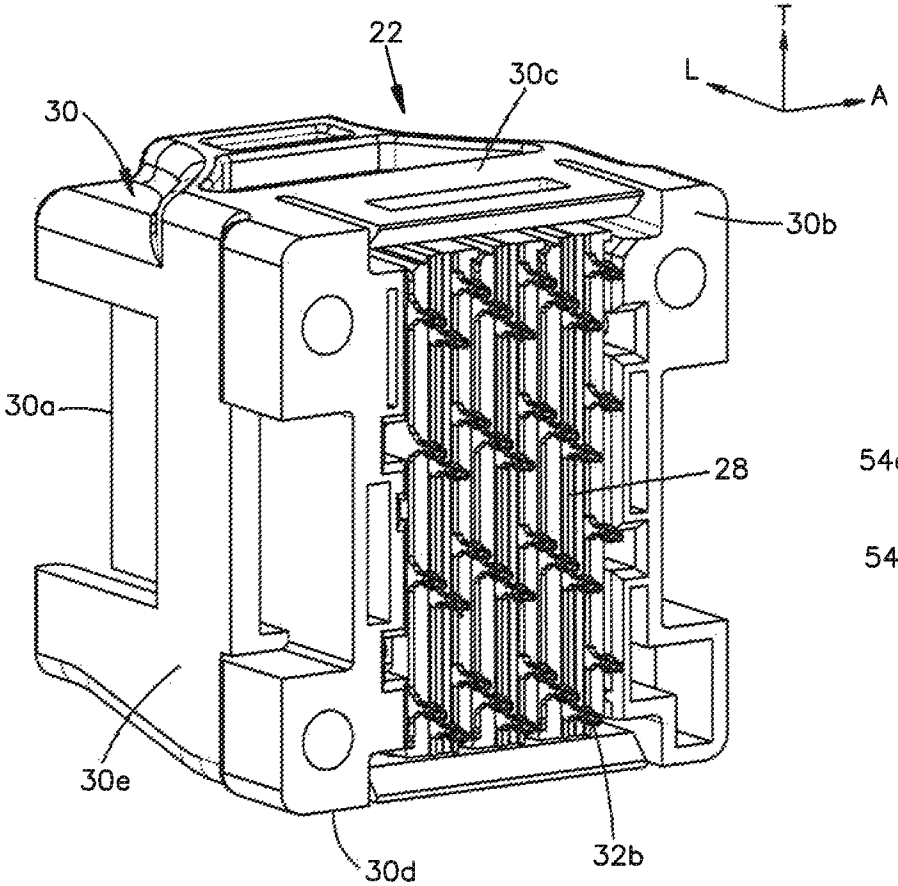
FIG. 2C is another perspective view of the first electrical connector shown in FIG. 1.
Figure 2F:
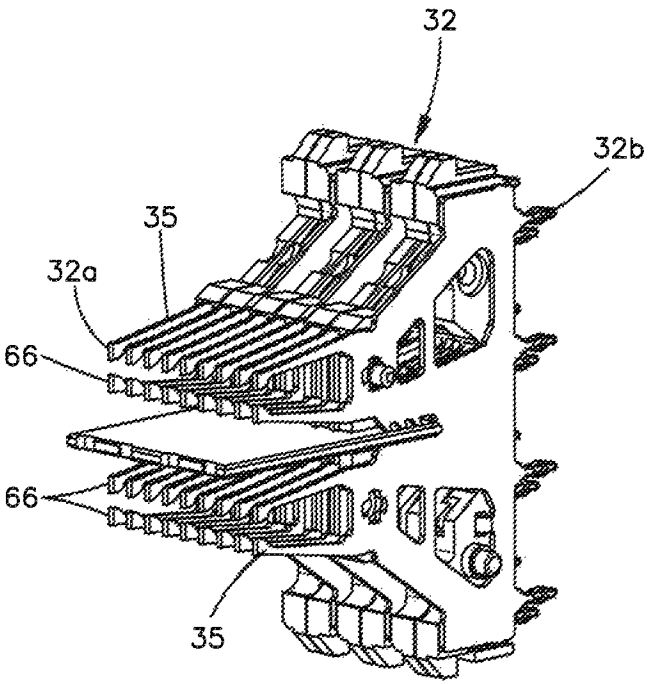
FIG. 2F is a perspective view similar to FIG. 2E, but with a connector housing of the first electrical connector removed.
Figure 2E:
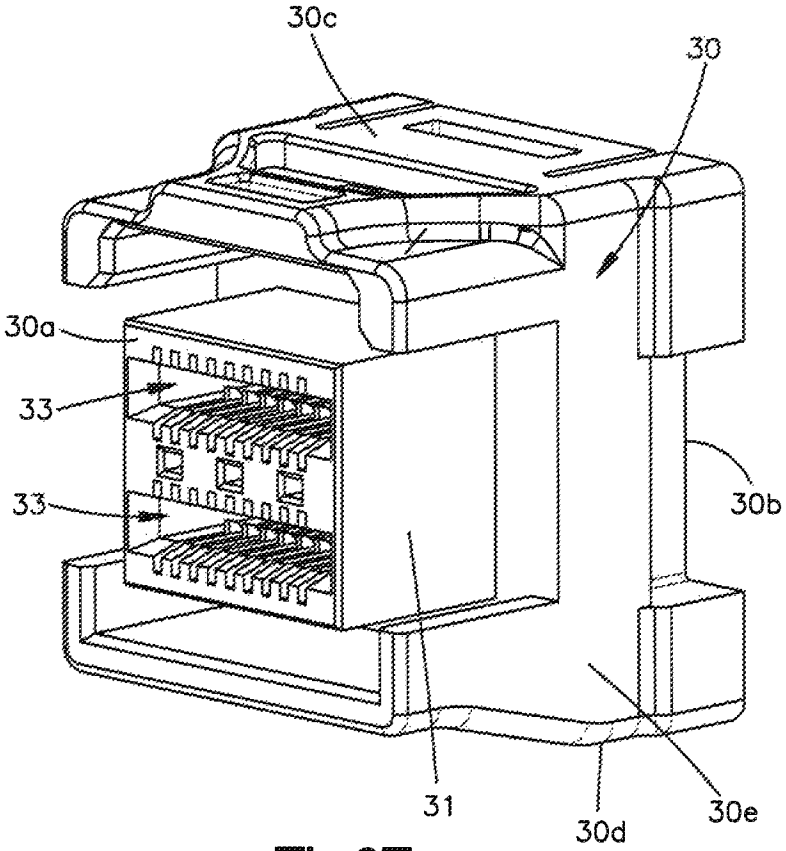
FIG. 2E is another perspective view similar to FIG. 2A, but with the guide members of the first electrical connector removed.

With particular reference to FIGS. 2B, 3A, and 4, in accordance with the illustrated embodiment, the electrical connector 22 includes an electrical contact assembly 52 that includes at least one electrical contact, for instance the plurality of electrical contacts 32, that includes the mating end 32*a*. The electrical contact assembly 52 can further include at least one movable electrically insulative guide member, for instance a plurality of electrically insulative guide members 54. The connector housing 30 can include a housing body 31 and at least one movable electrically insulative guide member, such as the plurality of electrically insulative guide members 54, that are supported by the housing body 31. At least one electrically insulative guide member 54 can be disposed adjacent the mating end 32 of at least one electrical contact 32. Further, the at least one electrically insulative guide member 54 can be configured to prevent the at least one electrical contact 32 from stubbing on the corresponding mating portion of the complementary electrical component.

The guide members 54 can be made of any electrically insulative material as desired, for instance plastic. The guide members 54 can be monolithic with the housing body 31. Alternatively, the guide members 54 can be separate from the housing body 31 and supported by the housing body 31. At least one electrical contact 32 can be supported by the housing body 31. The electrical contact 32 can include the first and second contact beams 35*a* and 35*b*, and each of the first and second contact beams 35*a* and 35*b* can define the mating end 32*a* that is at least partially disposed within the receptacle 33 of the connector housing. The illustrated electrical contacts 32 include pairs of the first and second contact beams 35*a* and 35*b*, respectively, that are spaced from each other along the transverse direction T that is substantially perpendicular to the mating direction M. The first and second contact beams 35*a* and 35*b* can define inner surfaces 60*a* and 60*b*, respectively, that face each other. Each of the inner surfaces 60*a* and 60*b* can be configured to contact the complementary electrical component 24 when the first electrical connector 22 is mated to the complementary electrical component 24. In accordance with the illustrated embodiment, the first contact beam 35*a* of a given pair of contact beams 35 is disposed a distance from the top end 30*c* that is less than a distance that the second contact beam 35*b* of the given pair of contact beams 35 is disposed from the top end 30*c* along the transverse direction T. Thus, in accordance with the illustrated embodiment, the first contact beam 35*a* is above the corresponding second contact beam 35*b* and the second contact beam 35*b* is below the corresponding first contact beam 35*a* along the transverse direction T.

Figure 3B:
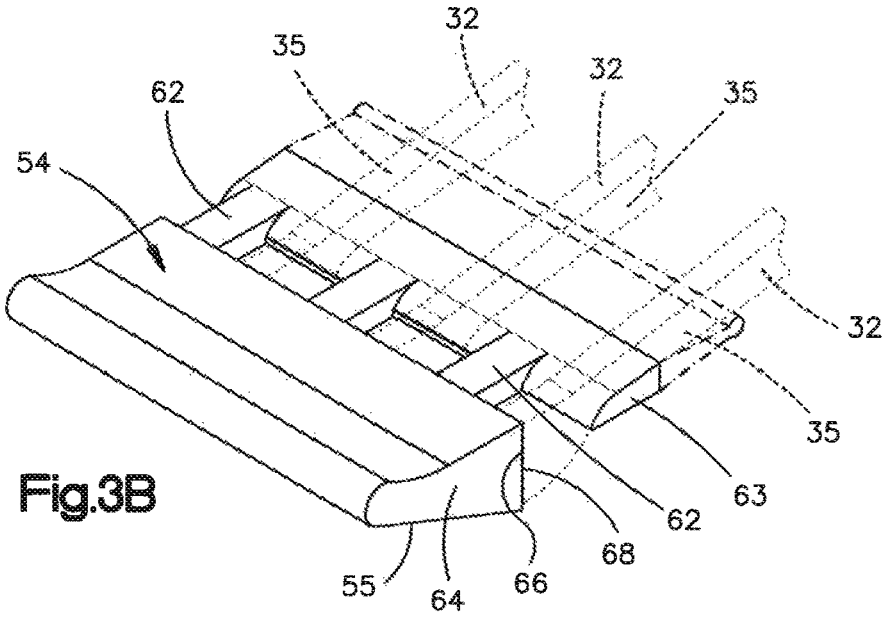
FIG. 3B is an enlarged view of one of the guide members and a portion of the electrical contacts of the first electrical connector shown in FIG. 1.

Referring in particular to FIG. 3B, at least one guide member, for instance the guide member 54, can include one or more first portions 62 that can be elongate in the longitudinal direction L and a lead in 64 that is disposed adjacent the mating end 32*a* of at least one of the first and second contact beams 35*a* and 35*b*. The first portions 62 can be monolithic with the lead in 64 or the first portions 62 can be separate and attached to the lead ins 64. The guide member 54 can further include a second portion 63 that can be elongate in the lateral direction A, wherein the first portions 62 can extend from the second portion 63 to the lead in 64 along the longitudinal direction L. The second portion 63 can be monolithic with the first portions 62. Alternatively, the second portion 63 can separate from the first portions 62 and attached to the first portions 62. The at least one guide member 54, and in particular the lead in 64, can define a surface 55, for instance a guide surface 55. The guide surface 55 can be defined along a plane that is angularly offset with respect to each of the mating direction M and the transverse direction T, such that the guide surface 55 can be configured to guide the complementary electrical component 24 from one of the first and second contact beams 35*a* and 35*b* toward the other of the first and second contact beams 35*a* and 35*b* as the complementary electrical component 24 is received by the receptacle 33 along the mating direction M.

Each of the gaps 50*a* and 50*b* can be defined by a pair of guide members 54, for instance first and second guide members 54*a* and 54*b*, that are disposed on opposed transverse sides of the receptacle 33. The electrical contact assembly 52 can include the first and second guide members 54*a* and 54*b* that can be at least partially disposed within the receptacle 33 of the connector housing. The illustrated electrical contact assembly 52 includes pairs of the first and second guide members 54*a* and 54*b*, respectively, that are spaced from each other along the transverse direction T that is substantially perpendicular to the mating direction M. The first and second guide members 54*a* and 54*b* can define respective guide surfaces 55 that face each other. At least one, for instance both, of the guide surfaces 55 of the first and second guide members 54*a* and 54*b* can be configured to contact the complementary electrical component 24 as the first electrical connector 22 is mated to the complementary electrical component 24 along the mating direction M.

In accordance with the illustrated embodiment, the lead in 64 can abut the mating end 32*a* of at least one of the first and second contact beams 35*a* and 35*b*. For instance, the lead in 64 of the first guide member 54*a* can abut the mating end 32*a* of the first contact beam 35*a*, and the lead in 64 of the second guide member 54*b* can abut the mating end 32*a* of the second contact beam 35*b*. Further, in accordance with the illustrated embodiment, a plurality of the first portions 62 of each guide member 54 can be spaced from each other along the lateral direction A. A portion of ones of the contact beams 35, and in particular the mating end 32*a* of the contact beam 35, can be disposed between adjacent ones of the first portions 62. Further, the second portions 63 of each guide member 54 can abut ones of the inner surfaces 60*a* and 60*b* of the contact beams 35. For instance, the second portion 63 of the first guide member 54*a*, and in particular an upper surface of the second portion 63 of the first guide member 54*a*, can abut the inner surface 60*a* of the first contact beam 35*a*. The second portion 63 of the second guide member 54*b*, and in particular a lower surface of the second portion 63 of the second guide member 54*b*, can abut the inner surface 60*b* of the second contact beam 35*b*. Each of the guide members 54 extend along the lateral direction A so as to abut at least one up to all of the electrical contacts 32. As shown, the guide members 54 abut all of the plurality of electrical contacts 32. It should be appreciated that the guide members 54 can be alternatively shaped as desired. For instance, the guide members 54 can be constructed so as to only abut one contact beam 35. Thus, the electrical connector 22 can include a plurality of guide members 54 spaced from each other along the lateral direction A.

Referring also to FIG. 1A, the complementary electrical component 24 can include at least one, for instance two, printed circuit boards 36. The inner surface 60*a* of the first contact beam 35*a* can be configured to ride along an upper surface 36*a* of the printed circuit board 36 as the printed circuit board 36 is received in the receptacle 33 along the mating direction M, and the inner surface 60*b* of the second contact beam 35*b* can be configured to ride along a lower surface 36*b* of the printed circuit board 36 as the printed circuit board 36 is received in the receptacle 33 along the mating direction M. In accordance with the illustrated embodiment, the upper surface 36*a* is opposite the lower surface 36*b* along the transverse direction T.

The first and second contact beams 35*a* and 35*b* can be configured to resiliently deflect away from each other as the printed circuit board 36 is mated with the electrical contact assembly 52 so as to increase the width of the gap 50 along the transverse direction T. For instance, the gap 50 can define a first width when the electrical connector 22 is in an unmated position, and the gap can define a second width that is greater than the first width when the electrical connector is in a mated position with the complementary electrical component 24. For instance, the printed circuit board 36 can define a thickness along the transverse direction that is substantially equal to the width of the gap 50 when the printed circuit board 36 is mated with the electrical contact assembly 52. The thickness of the printed circuit board 36 can be equal to a distance between the upper surface 36*a* and the lower surface 36*b* along the transverse direction T. In one embodiment, the first and second guide members 54*a* and 54*b* can be configured to resiliently deflect away from each other as the printed circuit board 36 is mated with the electrical connector 22 so as to increase the width of the gap 50 along the transverse direction T. In particular, the lead in 64 of the first guide member 54*a* and the lead in 64 of the second guide member 54*b* can be configured to resiliently deflect away from each other as the printed circuit board 36 is mated with the electrical connector 22. Alternatively, the first and second guide members 54*a* and 54*b* can be configured to remain stationary as the printed circuit board is mated with the electrical connector 22.

In accordance with the illustrated embodiment, the first and second contact beams 35*a* and 35*b* each define a front surface 66 at the mating end 32*a*, and the lead in 64 of the guide member 54 defines a rear surface 68 that abuts the front surface 66 of at least one of the first and second contact beams 35*a* and 35*b* such that the front surface 66 is covered when the front surface 66 is viewed from the front end 30*a* of the connector housing 30 toward the rear end 30*b* of the connector housing 30 along the mating direction M. The front surface 66 can define a plane that is substantially perpendicular to the mating direction M and substantially parallel to the transverse direction T. The front surface 66 can be spaced from the rear end 30*b* along the longitudinal direction L. The front surface 66 of the contact beam 35 can be attached to the rear surface 68 of the guide member 54. Thus, the guide member 54 can be attached to at least one, for instance all, of the contact beams 35. Although the illustrated contact beams 35 define the front end 66 that defines a vertical plane, it will be understood that the contact beams 35, and thus the electrical contacts 32, can be alternatively shaped as desired. For instance, the contact beams 35 can define a rounded front end so as to guide the complementary electrical component 24 into the gap 50 as the complementary electrical component 24 is mated with the electrical connector 22 along the mating direction M.

In accordance with an example embodiment, as the complementary electrical component 24 is received by the receptacle 33 along the mating direction M, only the first contact beams 35*a* that are above the second contact beams 35*b* along the transverse direction T abut the guide members 54 such that the guide surface 55 of the first guide member 54*a* guides the complementary electrical component 24 substantially downward toward the second contact beams 35*b*. The second contact beams 35*b* can define a rounded front end, or can be alternatively shaped as desired. Alternatively, in accordance with another example embodiment, as the complementary electrical component 24 is received by the receptacle 33 along the mating direction M, only the second contact beams 35*b* that are below the first contact beams 35*b* along the transverse direction T abut the guide members 54 such that the guide surface 55 of the second guide member 54*a* guides the complementary electrical component 24 substantially upward toward the first contact beams 35*a*. The first contact beams 35*a* can define a rounded end, or can be alternatively shaped as desired. Alternatively still, in accordance with the illustrated embodiment, the first and second contact beams 35*a* and 35*b* can abut the first and second guide members 54*a* and 54*b*, respectively. Thus, at least one of the first and second guide members 54*a* and 54*b* can guide the complementary electrical component 24 toward the other of the first and second guide members 54*a* and 54*b* as the complementary electrical component 24 is received by the receptacle 33. Further, each of the first and second contact beams 35*a* and 35*b* can abut ones of the plurality of guide members 54 such that the complementary electrical component 24 is guided toward the gap 50 defined by the inner surfaces 60*a* and 60*b* as the complementary electrical component 24 is received in the receptacle 33. It will be understood that the number and placement of the guide members can vary as desired.

Thus, the lead in 64 can be disposed adjacent the mating end 32*a* of the first contact beam 35*a*, and the first contact beam 35*a* can be spaced from the second contact beam 35*b* in a select direction. The connector housing 30 can include the housing body 31 that defines the receptacle 33, and the connector housing 30 can further include the at least one guide member 54 resiliently supported by the housing body 31, such that the guide member 54 deflects in the select direction when the complementary electrical component 24 rides along the guide surface 55 as the complementary electrical component 24 is received in the receptacle 33. In particular, the second portion 63 can be supported by the housing body 31. For instance, the second portion 63 of the first guide member 54*a* can be supported by the housing body 31 such that the first contact beam 35*a* flexes about the second portion 63 of the first guide member 54*a* when the complementary electrical component 24 is mated with the first electrical connector 22. Similarly, the second portion 63 of the second guide member 54*b* can be supported by the housing body 31 such that the contact beam 35*b* flexes about the second portion of the second guide member 54*b* when the complementary electrical component 24 is mated with the first electrical connector 22. Further, the electrical contact assembly 52 can define the lead in 64 that is disposed adjacent the mating end 32*a* of at least one of the first and second contact beams 35*a* and 35*b* in a direction opposite the mating direction M in which the printed circuit board 36 is received.

In one embodiment, at least one guide member 54 can be movable with respect to the receptacle 33. For instance, at least one guide member 54 can be attached to at least one of the first and second contact beams 35 and 35*b* or can be otherwise movable with at least one of the first and second contact beams. When the complementary electrical component 24 applies a force to the guide surface 55 as the complementary electrical component 24 is received by the receptacle 33, the lead in 64 can be configured to cause at least one of the contact beams 35*a* and 35*b* to move with the lean in 64. For instance, the lead in 64 of the first guide member 54*a* and the first contact beam 35*a* can move substantially upward along the transverse direction T as the complementary electrical component 24 contacts the guide surface 55 of the first guide member 54*a* along the mating direction M. Similarly, the lead in 64 of the second guide member 54*b* and the second contact beam 35*b* can move substantially downward along the transverse direction T as the complementary electrical component 24 contacts the guide surface 55 of the second guide member 54*b* along the mating direction M. Alternatively, at least one of the guide members 54 can be movable with respect to the electrical contact 32. For instance, at least one electrically insulative guide member 54 can be pivotally or rotationally movable with respect to the mating end 32*a* of at least one electrical contact 32. The lead in 64 can be disposed in the gap 50 along the transverse direction T when the electrical connector assembly 52 is in an unmated position with respect to the printed circuit board 36, and the lead in 64 can be configured to move along the transverse direction T as the printed circuit 36 is received in the receptacle 33 such that the lead in 64 is offset from the gap 50 along the transverse direction T when the electrical connector 22 is in a mated position with respect to the printed circuit board 36. Alternatively still, the lead in 64 can be configured to remain stationary as the printed circuit board 36 is received in the receptacle 33.

With reference to FIGS. 1A and 1B, the second electrical connector 24 can include a dielectric or electrically insulative second connector housing 34 and at least one printed circuit board 36 that is carried by the second connector housing 34. The second connector housing 34 can define a front end 34*a* and a rear end 34*b* that is spaced from the front end 34*a* along the longitudinal direction L, a top end 34*c* and a bottom end 34*d* that is spaced from the top end 34*c* along the transverse direction T, and opposed sides 34*e* that are spaced from each other along the lateral direction A. Each of the front end rear ends 34*a* and 34*b* can define respective front and rear surfaces that are elongate in a plane that is defined by the lateral direction A and the transverse direction T. The second electrical connector 24 defines the mating interface 27 that can be defined by the front end 34*a* of the second connector housing 34 and is configured to mate with the mating interface 26 of the first electrical connector 22 when the first and second electrical connectors 22 and 24 are mated to each other. The second electrical connector further defines a mounting interface 29 that is configured to be mounted onto a corresponding electrical component so as to establish an electrical connection between the second electrical connector 24 and the corresponding electrical component, which can include one or more cables. Thus, the second electrical connector 24 and the one or more cables can define a cable assembly that is configured to mate with the first electrical connector 22 so as to place at least one cable in electrical communication with the first electrical connector 22, and thus to the electrical component to which the first electrical connector 22 is mounted when the first electrical connector 22 is mounted to the corresponding electrical component.

The electrical connector 24 can include a pair of printed circuit boards 36 that are supported by the second connector housing 34 and spaced from each other along the transverse direction T. Each of the substrates 36 can, for instance, be disposed proximate to the mating interface 27, and are configured to be inserted into respective ones of the corresponding pair of receptacles 33 of the first electrical connector 22 when the first electrical connector 22 is mated to the second electrical connector 24, thereby establishing an electrical connection between the printed circuit board 36 and ones of the electrical contacts 32 of the first electrical connector 22. Accordingly, the electrical connector 24 can be referred to as a plug connector having at least printed circuit board 36 that is received in a corresponding receptacle of the first electrical connector 22 so as to establish an electrical connection between ones of the electrical contacts 32 of the first electrical connector 22 and the at least one printed circuit board 36.

The printed circuit board 36 can include a plurality of electrical signal conductors and ground conductors that are configured to contact the inner surfaces 60*a* and 60*b* of the contact beams 35*a* and 35*b*, respectively, when the complementary electrical component 24 is mated with the electrical connector 22 so as to establish an electrical connection between the electrical connector 22 and the complementary electrical component 24. In accordance with an example embodiment, signal contact pads are carried by a respective one of the upper and lower surfaces 36*a* and 36*b*, and a signal trace can likewise be carried by the respective one of the upper and lower surfaces 36*a* and 36*b*. When the printed circuit board 36 is inserted into the receptacle 33 of the first electrical connector 22, the signal contact pads that are carried by the upper surface 36*a* are configured to contact the one of the first contact beams 35*a*. Similarly, when the printed circuit board 36 is inserted into the receptacle 33 of the first electrical connector 22, the signal contact pads that are carried by the lower surface 36*b* are configured to contact the second contact beams 36*b* that are below the first contact beams 35*a*. It is to be understood that the ground conductors and signal conductors are configured to be mated with respective complementary electrical ground contacts and electrical signal contacts of the first electrical connector 22.

It will be understood that the described contact beams 35 can define a length along the mating direction M that is less than the length of conventional contact beams. For instance, the electrically insulative guide members can replace portions of the electrical contacts in conventional electrical connectors. Without being bound by theory, shortening electrical contacts can reduce electrical stubbing.

In operation, the electrical connector 22 can be mated with the complementary electrical component 24 comprising the printed circuit board 36 by causing the printed circuit board to contact at least one electrically insulative guide member 54 such that the at least one electrically insulative guide member 54 moves with the mating end 32*a*. For instance, the guide members 54 can move with the mating ends 32*a* of respective first and second contact beams 35*a* and 35*b*. The guide member 54 can be moved with respect to the housing body 31. In accordance with another example embodiment, the electrical connector 22 can be mated with the complementary electrical component 24 comprising the printed circuit board 36 by causing the printed circuit board 36 to contact at least one electrically insulative guide member 54 such that the at least one electrically insulative guide member 54 moves with respect to the mating end 32*a*. For instance, the guide members 54 can move with respect to the mating end 32 of the first and second contact beams 35*a* and 35*b*. The at least one guide member 54 can be deflected in a select direction, wherein the first contact beam 35*a* and the second contact beam 35*b* are spaced apart from each other in the select direction. In accordance with yet another embodiment, the electrical connector 22 can be mated with the complementary electrical component 24 comprising a printed circuit board 36 by causing the printed circuit board 36 to contact at least one electrically insulative guide member 54 such that the mating end 32*a* deflects while the at least one electrically insulative guide member 54 remains stationary with respect to the housing body 31. At least one, for instance both, of the first and second contact beams 35*a* and 35*b* can deflect while the at least one guide member 35 remains stationary with respect to the housing body 31.

It should be noted that the illustrations and discussions of the embodiments shown in the figures are for exemplary purposes only, and should not be construed limiting the disclosure. One skilled in the art will appreciate that the present disclosure contemplates various embodiments. It should be further appreciated that the various alternative embodiments described above with respect to one illustrated embodiment can apply to all embodiments as described herein, unless otherwise indicated.

What is claimed:

1. An electrical connector configured to mate with a complementary electrical component, the electrical connector comprising:

an electrically insulative connector housing; and at least one electrical contact supported by the electrically insulative connector housing, the at least one electrical contact including a mating end, wherein:

the electrically insulative connector housing includes at least one movable electrically insulative guide member that is disposed adjacent the mating end of the at least one electrical contact;

the electrically insulative connector housing comprises a receptacle configured to receive the complementary electrical component along a mating direction;

the at least one moveable electrically insulative guide member is movable with respect to the receptacle in a direction transverse to the mating direction;

the at least one movable electrically insulative guide member is configured to prevent the at least one electrical contact from stubbing on a corresponding mating portion of the complementary electrical component; and the at least one electrical contact includes first and second contact beams that each define the mating end at least partially disposed in the receptacle, the first and second contact beams spaced from each other along a transverse direction that is substantially perpendicular to the mating direction, wherein the first and second contact beams are configured to deflect away from each other along the transverse direction as the complementary electrical component is mated with the electrical connector.

2. The electrical connector as recited in claim 1, wherein the at least one movable electrically insulative guide member defines a lead in that is disposed adjacent to the mating end of at least one of the first and second contact beams, and the at least one movable electrically insulative guide member defines a guide surface along a plane that is angularly offset with respect to each of the mating direction and the transverse direction, such that the guide surface is configured to guide the complementary electrical component from the one of the first and second contact beams toward the other of the first and second contact beams as the complementary electrical component is received by the receptacle along the mating direction.

3. The electrical connector as recited in claim 2, wherein the lead in abuts the mating end of the at least one of the first and second contact beams.

4. The electrical connector as recited in claim 2, wherein the first and second contact beams each define a front surface at the mating end, and the lead in of the at least one movable electrically insulative guide member defines a rear surface that abuts the front surface of the at least one of the first and second contact beams such that the front surface is covered when viewed along the mating direction from a front end of the connector housing toward a rear end of the connector housing.

5. The electrical connector as recited in claim 4, wherein the front surface defines a plane substantially perpendicular to the mating direction and parallel to the transverse direction.

6. The electrical connector as recited in claim 4, wherein the rear surface of the at least one movable electrically insulative guide member is attached to the front surface of the at least one of the first and second contact beams.

7. The electrical connector as recited in claim 2, wherein as the complementary electrical component is received by the receptacle along the mating direction, only the first contact beam that is above the second contact beam along the transverse direction abuts the at least one movable electrically insulative guide member such that the guide surface of the at least at least one movable electrically insulative guide member guides the complementary electrical component substantially downward toward the second contact beam.

8. The electrical connector as recited in claim 2, wherein as the complementary electrical component is received by the receptacle along the mating direction, only the second contact beam that is below the first contact beam along the transverse direction abuts the at least one movable electrically insulative guide member such that the guide surface of the at least one movable electrically insulative guide member guides the complementary electrical component substantially upward toward the first contact beam.

9. The electrical connector as recited in claim 8, wherein the first contact beam defines a rounded front end.

10. The electrical connector as recited in claim 1, wherein the first and second contact beams define respective inner surfaces that face each other, each inner surface configured to contact the complementary electrical component when the electrical connector is mated to the complementary electrical component.

11. The electrical connector as recited in claim 10, wherein:

the complementary electrical component comprises a printed circuit board;

the inner surface of the first contact beam is configured to ride along an upper surface of the printed circuit board as the printed circuit board is received in the receptacle along the mating direction, and the inner surface of the second contact beam is configured to ride along a lower surface of the printed circuit board as the printed circuit board is received in the receptacle along the mating direction; and wherein the upper surface is opposite the lower surface along the transverse direction.

12. The electrical connector as recited in claim 10, wherein the at least one movable electrically insulative guide member includes a plurality of movable electrically insulative guide members, the at least one electrical contact includes a plurality of electrical contacts that each include the first and second contact beam, and each of the first and second contact beams abut ones of the plurality of movable electrically insulative guide members such that the complementary electrical component is guided toward a gap defined by the inner surfaces as the complementary electrical component is received in the receptacle.

13. The electrical connector as recited claim 12, wherein:

the lead in is disposed adjacent the mating end of each of the first and second contact beams;

the first contact beams are spaced from the second contact beams in a select direction;

the connector housing includes a housing body that defines the receptacle; and the connector housing further includes the plurality of movable electrically insulative guide members resiliently supported by the housing body, such that the guide member deflects in the select direction when the complementary electrical component rides along the guide surface as the complementary electrical component is received in the receptacle.

14. The electrical connector as recited in claim 1, wherein at least one movable electrically insulative guide member is attached to the at least one of the first and second contact beams.

15. The electrical connector as recited in claim 1, wherein the at least one movable electrically insulative guide member is pivotally or rotationally movable with respect to the mating end of the at least one electrical contact.

16. An electrical contact assembly configured to be mated with a printed circuit board along a mating direction, the electrical contact assembly comprising:

a housing comprising a receptacle;

an electrical contact including a first contact beam and a second contact beam spaced from the first contact beam to define a gap along a transverse direction that is substantially perpendicular to the mating direction, wherein each of the first and second contact beams define respective mating ends that are at least partially disposed in the receptacle; and at least one electrically insulative guide member that defines a lead in that is disposed adjacent the mating end of at least one of the first and second contact beams in a direction opposite the mating direction in which the printed circuit board is received, wherein:

the at least one electrically insulative guide member is attached to at least one of the first and second contact beams such that the at least one electrically insulative guide member is movable with the electrical contact;

the at least one electrically insulative guide member is attached to a respective mating end of the first or second contact beam;

the at least one electrically insulative guide member is movable with respect to the housing; and the at least one guide member defining a guide surface along a plane that is angularly offset with respect to each of the mating direction and the transverse direction, such that the guide surface is configured to guide the printed circuit board from the one of the first and second contact beams toward the other of the first and second contact beams as the printed circuit board is received by the receptacle along the mating direction.

17. The electrical contact assembly as recited in claim 16, wherein the at least one guide member is movable with respect to the electrical contact.

18. The electrical contact assembly as recited in claim 16, wherein the first and second contact beams deflect away from each other as the printed circuit board is mated with the electrical contact assembly so as to increase a width of the gap along the transverse direction.

19. The electrical contact assembly as recited in claim 18, wherein the printed circuit board defines a thickness along the transverse direction that is substantially equal to the width of the gap when the printed circuit board is mated with the electrical contact assembly.

20. The electrical contact assembly as recited in claim 16, wherein the lead in is disposed in the gap along the transverse direction when the electrical contact assembly is in an unmated position with respect to the printed circuit board.

21. An electrical connector configured to mate with a complementary electrical component, the electrical connector comprising:

an electrically insulative connector housing, the electrically insulative connector housing comprising a receptacle configured to receive the complementary electrical component along a mating direction;

a plurality of movable electrical contacts that each comprises first and second contact beams, the plurality of movable electrical contacts supported by the connector housing, and the first and second contact beams of each of the plurality of movable electrical contact comprises a mating end at least partially disposed in the receptacle, the first and second contact beams being spaced from each other along a transverse direction that is substantially perpendicular to the mating direction, wherein:

the first and second contact beams comprise respective inner surfaces that face each other, each inner surface being configured to contact the complementary electrical component when the electrical connector is mated to the complementary electrical component;

the connector further comprises a plurality of movable electrically insulative guide members;

and each of the first and second contact beams abut one of the plurality of movable electrically insulative guide members such that the complementary electrical component is guided by the movable electrically insulative guide members toward a gap between the inner surfaces as the complementary electrical component is received in the receptacle.

* * * * *